US007791006B2

(12) United States Patent
Hasson et al.

(10) Patent No.: US 7,791,006 B2
(45) Date of Patent: Sep. 7, 2010

(54) EXO ATMOSPHERIC INTERCEPTING SYSTEM AND METHOD

(75) Inventors: Joseph Hasson, Neve Monson (IL); Galya Goldner, Tel Aviv (IL)

(73) Assignee: Israel Aerospace Industries Ltd., Lod (IL)

( * ) Notice: Subject to any disclaimer, the term of this patent is extended or adjusted under 35 U.S.C. 154(b) by 143 days.

(21) Appl. No.: 11/631,501

(22) PCT Filed: Jul. 5, 2005

(86) PCT No.: PCT/IL2005/000712

§ 371 (c)(1),
(2), (4) Date: Jan. 4, 2007

(87) PCT Pub. No.: WO2006/003660

PCT Pub. Date: Jan. 12, 2006

(65) Prior Publication Data

US 2008/0258004 A1 Oct. 23, 2008

(30) Foreign Application Priority Data

Jul. 5, 2004 (IL) ..... 162863

(51) Int. Cl.
*F41G 7/22* (2006.01)
*F42B 15/01* (2006.01)
*F41G 7/00* (2006.01)
*F42B 15/00* (2006.01)

(52) U.S. Cl. ..... 244/3.15; 244/3.1; 244/3.16; 244/3.19; 244/158.1; 342/61; 342/62; 89/1.11

(58) Field of Classification Search ..... 244/3.1–3.3, 244/158.1; 89/1.11; 342/52–56, 61–68, 342/175, 195; 701/200, 207, 220, 221, 226
See application file for complete search history.

(56) References Cited

U.S. PATENT DOCUMENTS 4,202,516 A 5/1980 Benser (Continued)

OTHER PUBLICATIONS

R.M. Bowman, "Star Wars and Security"; IEEE Technology and Society Magazine; vol. 4, issue 4; Dec. 1985; pp. 2-13; ISSN: 0278-0097.*

*Primary Examiner*—Bernarr E Gregory
(74) *Attorney, Agent, or Firm*—The Nath Law Group; Derek Richmond; Jiaxiao Zhang

(57) ABSTRACT

According to an embodiment of the present invention there is provided a kill-vehicle to be used in an exo-atmospheric anti-missile interceptor aimed at hitting a target, the kill-vehicle having a main body and comprising: an electronic box; a sensor unit coupled to the electronic box and including at least one sensor for tracking the target at a certain field of view; an inertial measurement unit coupled to the sensor unit; and a divert system controlled by the electronic box for providing the kill-vehicle with thrust at a desired direction; said divert system and electronic box constituting said main body, wherein the kill-vehicle further comprises at least one gimbals unit coupled to the main body and to the sensor unit for controllably changing an angle between the sensor unit and the main body, and wherein said electronic box is configured to synchronically operate said divert system and gimbals unit such that the target remains in the field of view of said at least one sensor and the thrust is provided in a direction required for hitting the target.

13 Claims, 6 Drawing Sheets

U.S. PATENT DOCUMENTS

| | | | | | |
|---|---|---|---|---|---|
| 4,541,591 | A | | 9/1985 | Chadwick et al. | |
| 4,542,870 | A | | 9/1985 | Howell | |
| 4,560,120 | A | | 12/1985 | Crawford et al. | |
| 5,022,608 | A | | 6/1991 | Beam | |
| 5,590,850 | A | | 1/1997 | Cannon et al. | |
| 5,681,009 | A | * | 10/1997 | Vandersteen et al. | 244/3.16 |
| 5,710,423 | A | * | 1/1998 | Biven et al. | 244/3.1 |
| 5,811,788 | A | * | 9/1998 | Wicke | 244/3.1 |
| 6,178,741 | B1 | * | 1/2001 | Nelson et al. | 244/3.22 |
| 6,527,222 | B1 | * | 3/2003 | Redano | 244/3.14 |
| 6,739,547 | B2 | * | 5/2004 | Redano | 244/3.14 |
| 7,032,858 | B2 | * | 4/2006 | Williams | 244/3.15 |
| 7,219,853 | B2 | * | 5/2007 | Williams | 244/3.14 |
| 7,348,918 | B2 | * | 3/2008 | Redano | 342/62 |
| 2003/0052221 | A1 | * | 3/2003 | Redano | 244/3.14 |
| 2004/0021033 | A1 | * | 2/2004 | Redano | 244/3.1 |

* cited by examiner

EXO ATMOSPHERIC INTERCEPTING SYSTEM AND METHOD

FIELD OF THE INVENTION

This invention relates to anti-missile defense system and a method thereof, and more specifically the invention relates to an exo-atmospheric intercepting system and a method thereof.

BACKGROUND OF THE INVENTION

According to a known approach, the interception of attacking ballistic missiles above the atmosphere can be achieved by launching an interceptor missile against the attacking missile. The interceptor is directed toward the attacking missile (the so called 'target') and preferably hits it or explodes in the vicinity of the target, hopefully causing the target severe damage and perhaps even complete destruction. Typically, the interceptor comprises a one (or several) stage booster and the so-called "kill vehicle", also known by its abbreviation, KV.

Generally, the KV is required to maneuver in space in order to adjust its position with regard to its target, to compensate for e.g. cuing errors raised by ground or space detection and tracking systems and onboard navigation errors and in response to tracked target maneuvers.

The following is a short description of known techniques for KV maneuvering in space:

by using a rocket motor equipped with a flexible nozzle combined with an Attitude Control System (ACS) utilizing cold gas ejection for achieving and maintaining an orientation. This technique is used e.g. by the Arrow® interceptor, available by the Israel Aircraft Industry®.

by firing small micro-rockets at the required direction. This technique is used e.g. in THADS (Theatre High Attitude Defense System), commercially available from Lockheed-Martin®.

by using a Divert and Attitude Control System (DACS), used e.g. in liquid or solid propellant based missile, such as SM2 and SM3 (Standard Missile) used by the US Navy.

There is a need in the art for an improved KV having improved maneuvering and divert capabilities. There is further a need in the art for an improved KV having improved sensor range and improved resolution.

SUMMARY OF THE INVENTION

According to one embodiment, the present invention provides for a kill-vehicle to be used in an exo-atmospheric anti-missile interceptor aimed at hitting a target, the kill-vehicle having a main body and comprising an electronic box; a sensor unit coupled to the electronic box and including at least one sensor for monitoring a field of view; an inertial measurement unit coupled to the sensor unit; and a divert system controlled by the electronic box for providing the kill-vehicle with thrust at a desired direction; the divert system and electronic box constituting the main body, wherein the kill-vehicle further comprises at least one gimbals unit coupled to the main body and to the sensor unit for controllably changing an angle between the sensor unit and the main body, and wherein said electronic box is configured to synchronically operate said divert system and gimbals unit such that the target remains in the field of view of said at least one sensor and the thrust is provided in a direction required for hitting the target.

According to an embodiment of the invention, the electronic box includes a processor, a power source, and drivers for driving the divert system. According to another embodiment, the electronic box further includes communication means.

According to one embodiment of the invention, the sensor is an electro-optic sensor. According to another embodiment, the sensor is an electromagnetic sensor. According to yet another embodiment, the sensor is a combination of electro-optic and electromagnetic sensor.

According to one embodiment of the invention, the gimbals include at least one rotary motor, an angle-measuring mechanism and an electronic circuitry.

According to another embodiment, the divert system comprises a thruster, a nozzle for providing the kill-vehicle with acceleration, and at least two linear actuators for bending the nozzle with respect to the thruster, wherein the nozzle having a flexible part and the linear actuators are operable for steering the nozzle there-between, thereby providing the acceleration at a desired direction.

According to an embodiment of the present invention, the range to the target is measured by measuring the line-of-sight (LOS) rate induced by a well-defined maneuver.

The present invention further provides for a method for operating an exo-atmospheric anti-missile interceptor aimed at hitting a target, said interceptor having a kill-vehicle that comprises at least a sensor unit, an electronic box, and a divert system, said electronic box and divert system constituting a main body; the method comprising:

- providing rotating means for controllably changing an angle between said main body and sensor unit;
- providing said divert system with controllable steering means for applying a thrust at a desired direction;
- tracking said target at certain a field of view of said sensor; and
- synchronically operating said rotating means, steering means and divert system such that the target remains in the field of view of the sensor and the thrust is applied in the direction required for the interceptor to hit the target.

BRIEF DESCRIPTION OF THE DRAWINGS

In order to understand the invention and to see how it may be carried out in practice, one embodiment will now be described, by way of non-limiting example only, with reference to the accompanying drawings, in which.

DETAILED DESCRIPTION OF THE INVENTION

Figure 1A:
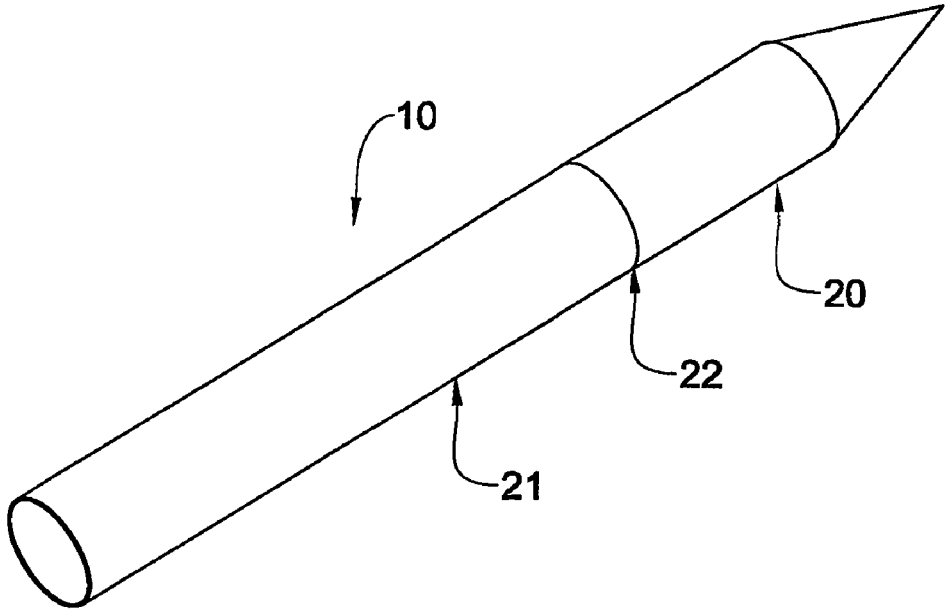
FIGS. 1*a*-1*b* are schematic illustrations of an interceptor according to an embodiment of the present invention.
Figure 1B:
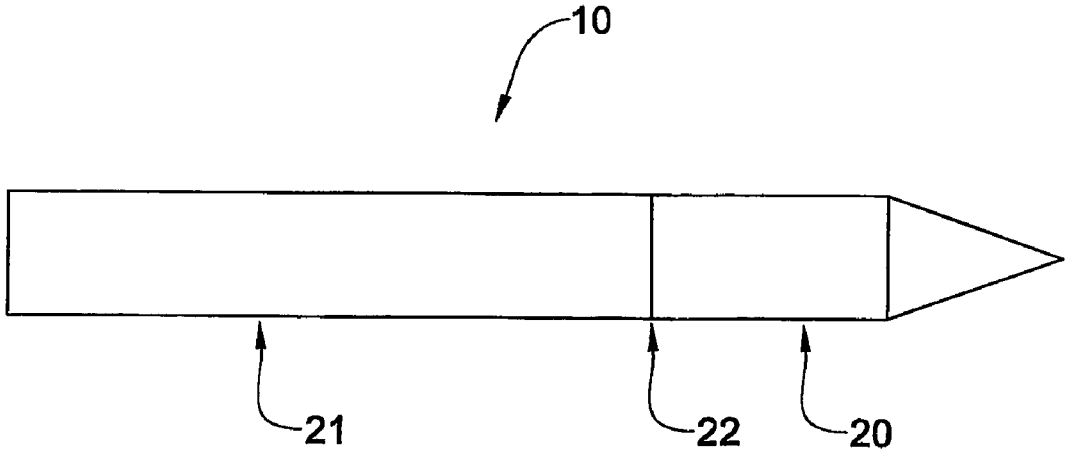

FIGS. 1*a*-1*b* are schematic illustrations of an anti-missile interceptor 10 according to an embodiment of the present invention, having a booster rocket 21 and a KV 20. Also shown is a separation mechanism 22, e.g. pyro-electric separation mechanism, used for separating, the booster from the KV at the appropriate conditions. It should be noted that the invention is not limited by the kind and type of booster rocket. Specifically, the invention is not limited by the one-stage booster as shown in FIGS. 1*a*-1*b*, and can be used e.g. with a two-stage booster.

According to one embodiment, the KV of the present invention is a commercially available KV in which modifications and additions are appropriately made in order to implement the concepts of the present invention. According to another embodiment of the invention, the KV is a dedicated device designed in accordance with the concept of the present invention.

Figure 2:
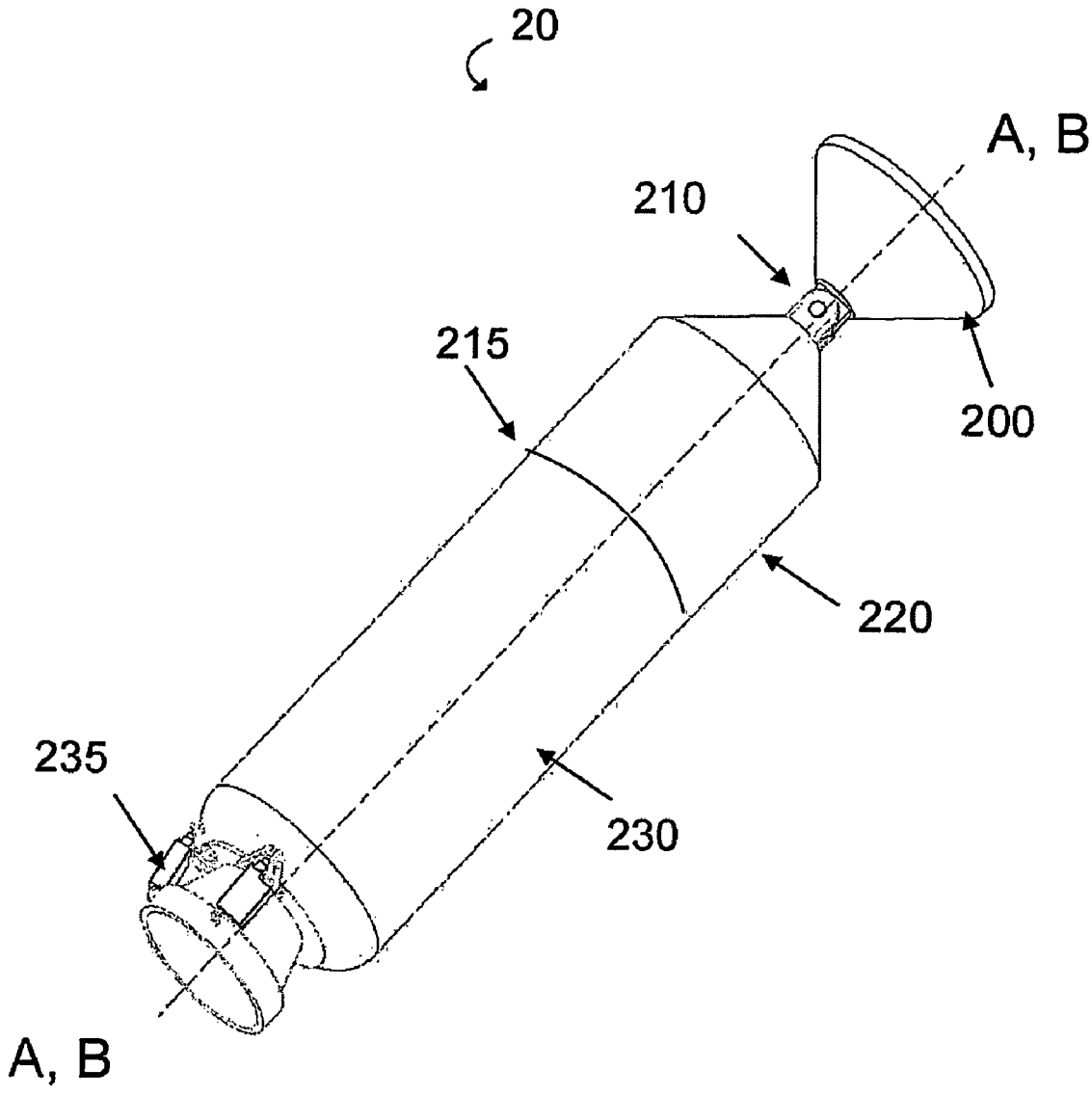
FIG. 2 is a schematic illustration of a KV according to an embodiment of the present invention.

FIG. 2 is a schematic illustration of a KV 20 according to an embodiment of the present invention. KV 20 comprises, inter-alia, the following main elements: an electronic box 220 which includes, inter-alia, power source, a processor, control means (e.g. drivers) and optional communication means, for e.g. receiving updates from a ground station or a space system (these elements are not shown in FIG. 2). The electronic box 220 is coupled to a motor 230 (the so-called 'thruster'), which, according to a non-limiting example shown in FIG. 2, is a solid propellant motor. The main body 215 of the KV, mainly comprising the electronic box 220 and the motor 230, is coupled to a sensor unit 200, which includes, inter-alia, a sensor (not shown in FIG. 2), e.g. an electro-optic or electromagnetic sensor used for detecting and tracking the attacking missile (the so-called 'target'). KV 20 is further equipped with an inertial measurement unit (IMU) (not shown in FIG. 2), coupled to the control means and perhaps coupled to or accommodated in the sensor unit 200. According to an embodiment of the present invention, KV 20 is equipped with a divert system 235, the structure and operation of which will be described further below.

Figure 3:
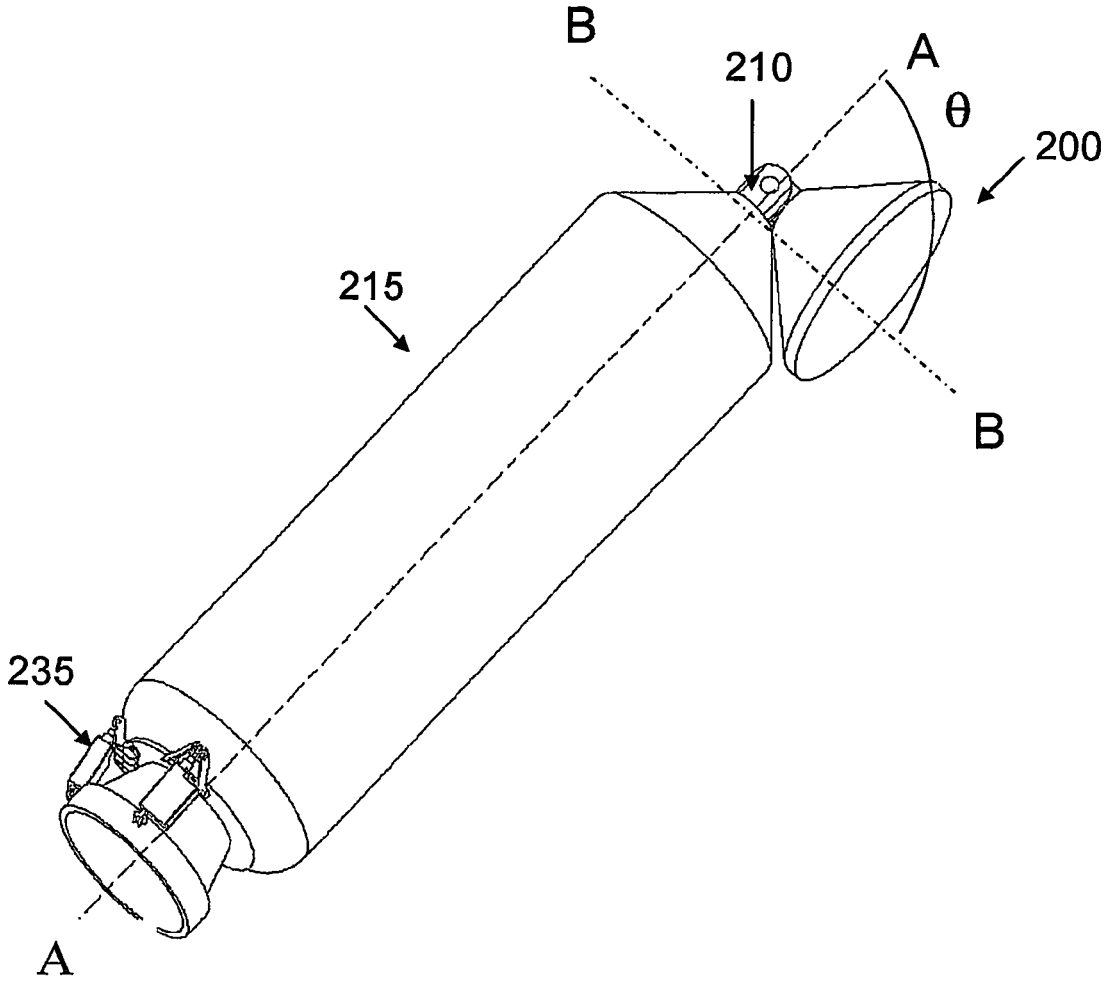
FIG. 3 is another schematic illustration of a KV according to an embodiment of the present invention.

According to an embodiment of the invention, the electronic box 220 and the sensor unit 200 are coupled via one or more gimbals 210, the function of which will be described now with reference to FIG. 2 together with FIGS. 3 and 4. Gimbals 210 control the relative angle between the main body 215 of the KV 20 (referring mainly to the electronic box 220 and the motor 230), represented in FIGS. 2-3 by a dashed axis line A, and the sensor unit 200, represented by a dashed axis line B.

In FIG. 2, axis lines A and B coincide. In this position, any thrust given to the KV along axis A will need to comply with the limitations under which operates the sensor unit, which are, mainly, continuously directing the sensor (i.e. axis B) toward the target. According to an embodiment of the present invention, the relative angle θ between axis A (the direction of the main body of the KV) and axis B (the direction of the sensor) can be controlled and changed, for example to the position shown in FIG. 3 (a 90° angle between axis A and axis B), thereby allowing the sensor 200 to maintain its direction toward the target while providing thrust along axis A. It should be appreciated that by dynamically adjusting the relative angle θ between the sensor 200 and the KV body 215 (i.e. between axis A and axis B) while maintaining the sensor axis toward the target, required thrust can be provided to the KV in any required direction in order to correct the missile course. By this, improved KV maneuvering and divert capabilities are achieved, as well as improved sensor range and resolution.

Figure 4A:
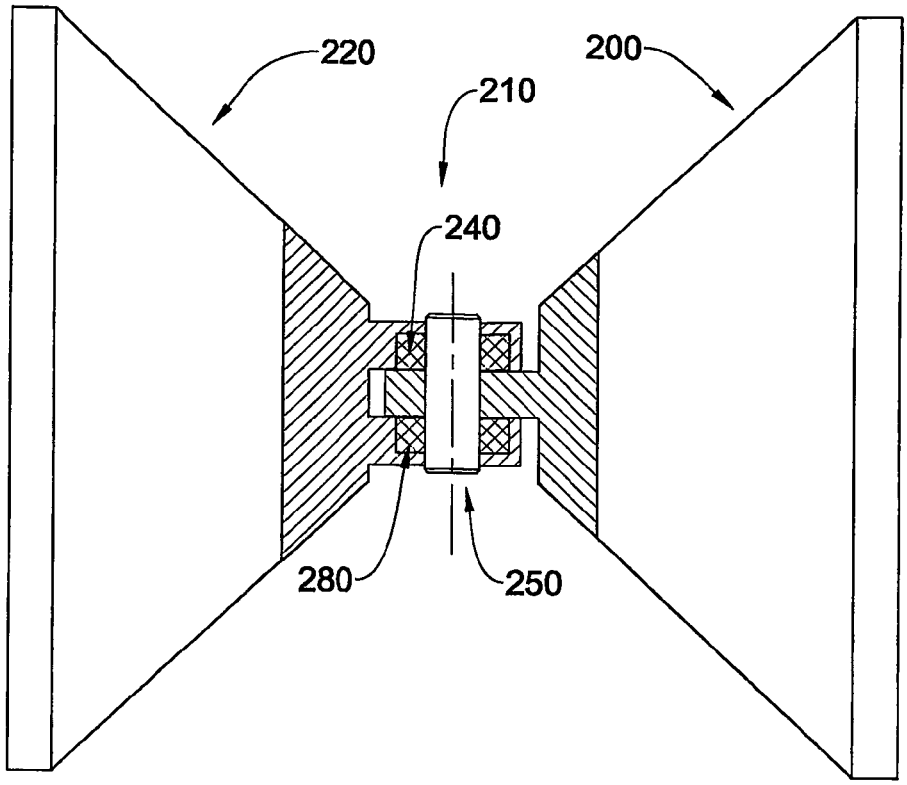
FIG. 4*a* is a partial cross-section of a KV according to an embodiment of the invention.
Figure 4B:
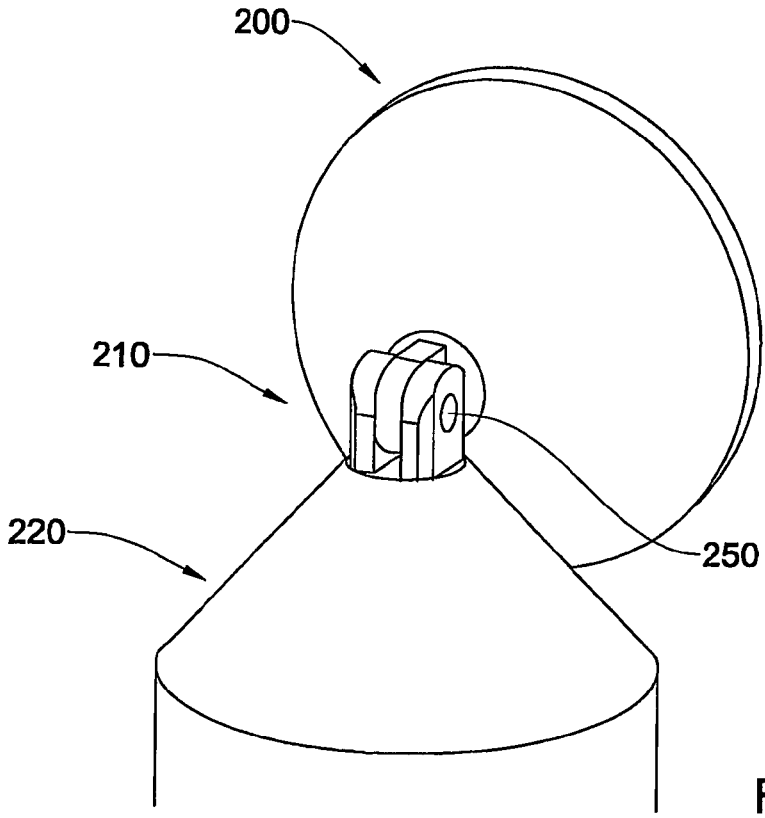
FIG. 4*b* is a partial side view of the KV shown in FIG. 4*a;*

Reference is now made to FIG. 4*a*, showing a schematic cross-section of a KV according to an embodiment of the invention. Gimbals unit 210 connects the sensor unit 200 with the electronic box 220. Gimbals unit 210 comprises one or more rotary motors 280 (e.g. brush-less DC motors) and an angle-measuring mechanism 240 (e.g. optical encoder), which are mounted onto the gimbals axis 250. Not shown in FIG. 4*a* is the IMU, which, as described with reference to FIG. 2, can be integrated within the sensor unit 200. FIG. 4*b* is a schematic side view of the KV shown in FIG. 4*a*, showing the gimbals axis 250. Preferably, Gimbals 210 are powered and controlled by the electronic box 220 (e.g. by drivers accommodated in the electronic box). Note that the electronic circuitry of the gimbals unit 210 is not shown in FIGS. 4*a*-4*b*.

In operation, gimbals 210 are operable (e.g. by drivers accommodated in the electronic box) to move the sensor unit 200 relative to the KV main body 215, thereby changing the angle θ there-between. The gimbals motors 280 are e.g. activated in a closed loop to minimize angular movements of the sensor unit in one or two directions perpendicular to the sensor axis B. Upon detection of the target, the motors 280 are activated such that the sensor axis B coincides with the line-of-sight (LOS) between the KV and the target. On a timely manner, the inertial velocity of the LOS is measured by the IMU and is used, in a manner known per-se, to calculate the maneuver along a direction perpendicular to the LOS needed to hit the target. Further considered is the range between the interceptor and the target, which is derived e.g. from the target trajectory transmitted to the interceptor by e.g. a ground station or a space system. The range can also be derived e.g. by measuring the change in the LOS angular velocity induced by the maneuvering of the KV.

Figure 5:
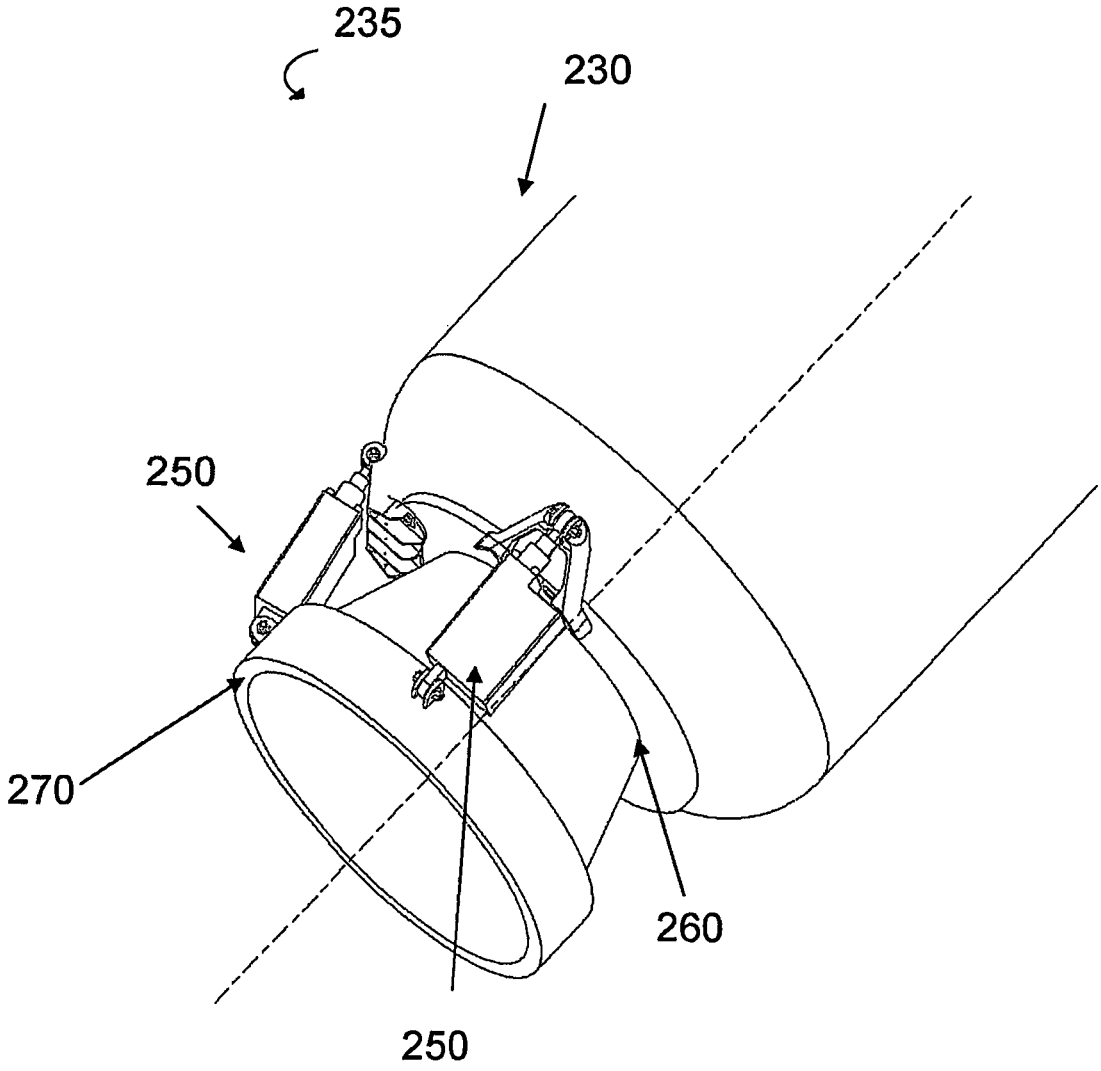
FIG. 5 is another partial side view of the KV according to an embodiment of the invention.

FIG. 5 is another partial side view of the KV shown in FIG. 2, showing schematically in a non-limiting manner, the divert system 235 mentioned above with reference to FIG. 2. According to an embodiment of the invention, the divert system 235 is controlled by the electronic box 220 (e.g. by drivers accommodated in the electronic box) and comprises, inter-alia, a nozzle 270 having flexible part 260, and linear actuators 290 coupling the nozzle to the thruster 230. The actuators 290 are located at a 90° angle to each other, steering the nozzle 270 there-between. Not shown in FIGS. 4*a*-4*b* and 5 are one or more gyros, used for working with one or more actuators 290 in closed loop to provide and maintain a desired direction.

In operation, the linear actuators 290 are used to steer the nozzle to the desired direction required to provide the main body of the KV (element 215 in FIG. 2) appropriate moment thereby enabling KV maneuvering by producing angular accelerations of the main body along the direction of the moment.

Figure 6:
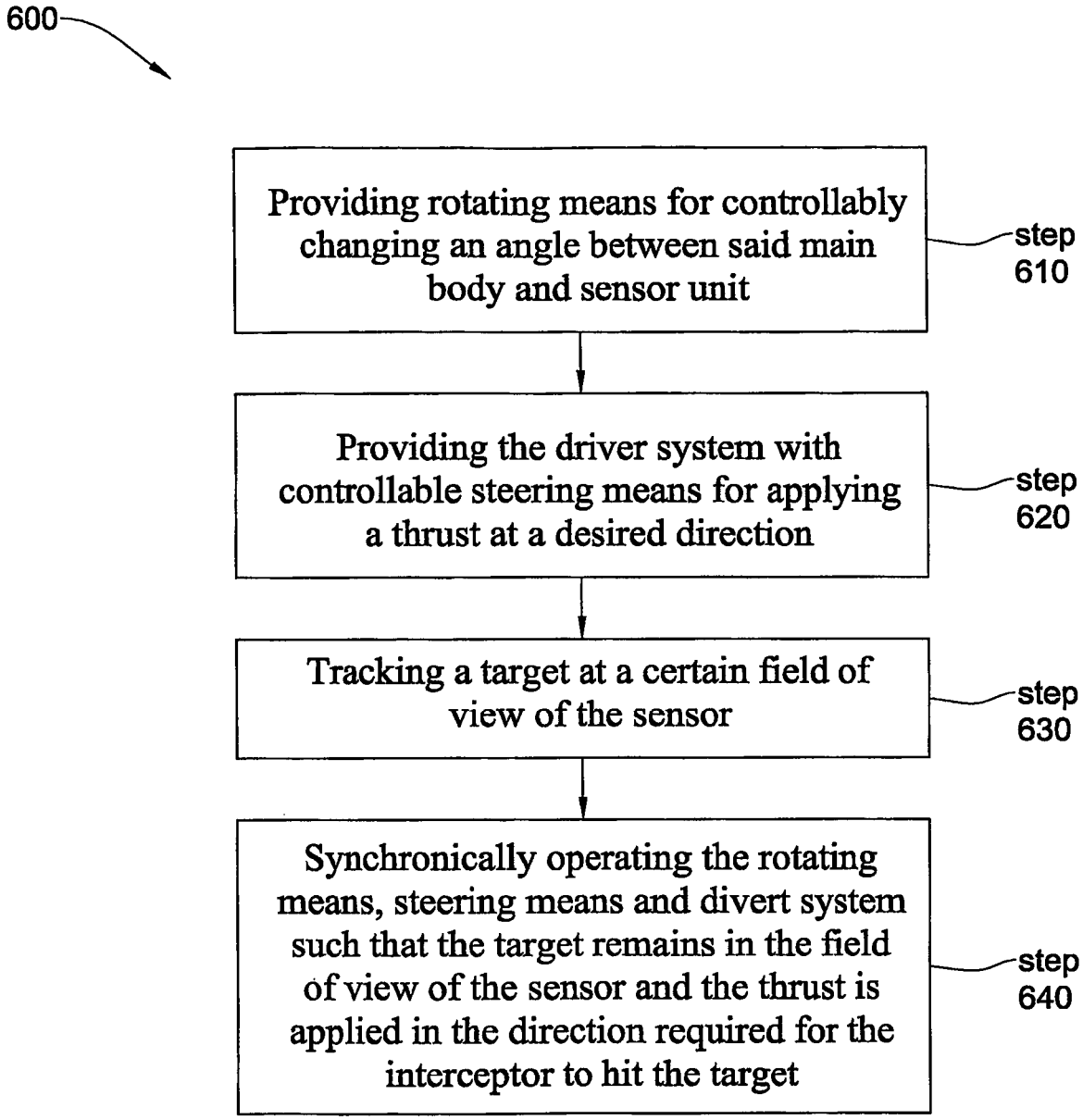
FIG. 6 is a schematic illustration of a method according to an embodiment of the present invention.

FIG. 6 schematically shows a method 600 according to an embodiment of the present invention, for operating an exo-atmospheric anti-missile interceptor aimed at hitting a target. The method is suitable for the operation of an interceptor having a kill-vehicle that comprises at least a sensor unit, and a main body that includes, inter alia, an electronic box and a divert system. The following are operational steps carried out according to the present invention:

At step 610: providing rotating means for controllably changing an angle between said main body and sensor unit.

At step 620: providing the divert system with controllable steering means for applying a thrust at a desired direction.

At step 630: tracking a target at a certain field of view of the sensor.

At step 640: synchronically operating the rotating means, steering means and divert system such that the target remains in the field of view of the sensor and the thrust is applied in the direction required for the interceptor to hit the target (interception).

The guidance law that defines the require acceleration vector perpendicular to the line of sight to the target for an interception can be one of many e.g. Augmented Proportional Navigation or Zero Effort Miss proportional navigation as described in chapter 2 of Tactical and Strategic Missile Guidance by Paul Zarchan. Once the required acceleration vector is defined, the control system uses the flexible nozzle and the gimbals motors to change the direction of the KV's motor to the direction that produce the required acceleration perpendicular to the line of sight to the target.

According to one embodiment of the invention, any change in the LOS direction (axis B shown in FIG. 3) is prevented while the motor (axis A shown in FIG. 3) is directed in the direction that ensures the required acceleration.

While the invention has been described with regard to a divert system having flexible nozzle, it will be appreciated that the invention equally applies to other embodiments wherein other types of divert means are used Although certain embodiments of the present invention have been described, this should not be construed to limit the scope of the appended claims. Those skilled in the art will understand that modifications may be made to the described embodiments. Moreover, to those skilled in the various arts, the invention itself herein will suggest solutions to other tasks and adaptations for other applications. It is therefore desired that the present embodiments be considered in all respects as illustrative and not restrictive, reference being made to the appended claims rather than the foregoing description to indicate the scope of the invention.

The invention claimed is:

1. An exo-atmospheric anti-missile kill-vehicle, the kill-vehicle comprising:

a main body of the kill vehicle, the main body including a divert system configured for providing the kill-vehicle with acceleration at a desired direction;

a controller;

a sensor unit configured for tracking a target along a LOS (Line of Sight);

at least one gimbal unit configured for changing a relative angle between the main body of the kill vehicle and the sensor unit; and an IMU (Inertial Measurement Unit) configured for measuring inertial angular velocity of the LOS, and wherein the controller is operatively connected to each of the sensor unit, the at least one gimbal unit, the divert system and the IMU, and the controller is configured for synchronizing operation of the divert system and the gimbal unit by dynamically adjusting the relative angle between the main body of the kill vehicle and the sensor unit.

2. The kill-vehicle according to claim 1, wherein the kill-vehicle is part of an exo-atmospheric anti-missile interceptor.

3. The kill-vehicle according to claim 2, wherein the controller is configured for synchronously controlling the gimbal unit and the divert system, so that the sensor unit maintains the LOS to the target and so that thrust is provided at any direction required for hitting the target.

4. The kill-vehicle according to claim 3, wherein the controller is configured for controlling the divert system so that it provides any relative angle within the hemisphere opposite to the line of sight to the target between the direction of thrust and the LOS.

5. The kill-vehicle according to claim 2, wherein the divert system comprises:

a thruster;

a nozzle coupled to the thruster and configured for providing the kill-vehicle with acceleration, the nozzle having a flexible part; and at least two linear actuators operable for bending the nozzle with respect to the thruster, the at least two linear actuators are configured for steering the nozzle there-between, thereby providing an acceleration at a desired direction.

6. The kill-vehicle according to claim 5, wherein the controller is further configured for measuring the LOS rate induced by a maneuver for deriving the acceleration perpendicular to the line of sight required for hitting the target.

7. The kill-vehicle according to claim 6, wherein the main body further comprises communication means, the communication means are operatively connected to the controller, and wherein the communication means are configured for transmitting target trajectory to the interceptor.

8. The kill-vehicle according to claim 1, wherein the sensor unit is selected from the group consisting of: an electro-optic sensor; an electro-magnetic sensor; and a combination of an electro-optic and electromagnetic sensor.

9. The kill-vehicle according to claim 1, wherein the gimbal unit includes at least one rotary motor and an angle-measuring mechanism.

10. A method of operating an exo-atmospheric anti-missile kill-vehicle, the method comprising:

tracking a target along a LOS (Line of Sight) of a sensor unit of the kill vehicle;

utilizing a gimbal unit coupled to the sensor unit and a main body of the kill vehicle for changing a relative angle between the main body and the sensor unit;

measuring inertial angular velocity of the LOS; and synchronizing an acceleration of the kill-vehicle at a desired direction and the changing of the relative angle between the main body of the kill vehicle and the sensor unit.

11. The method according to claim 10, further comprising calculating the acceleration of the kill-vehicle according to a guidance law to determine a direction required for hitting the target and a respective required thrust along the main body at the relative angle.

12. The method according to claim 11, further comprising measuring the LOS rate induced by a maneuver for deriving the acceleration perpendicular to the line of sight required for hitting the target.

13. The method according to claim 10, wherein utilizing a gimbal comprises providing any relative angle within the hemisphere opposite to the line of sight to the target between the direction of thrust and the LOS.

* * * * *